US006822227B1

(12) United States Patent
Hidalgo et al.

(10) Patent No.: US 6,822,227 B1
(45) Date of Patent: Nov. 23, 2004

(54) TIME-OF-FLIGHT MASS SPECTROMETRY UTILIZING FINITE IMPULSE RESPONSE FILTERS TO IMPROVE RESOLUTION AND REDUCE NOISE

(75) Inventors: August Hidalgo, San Francisco, CA (US); Ken Poulton, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/628,953

(22) Filed: Jul. 28, 2003

(51) Int. Cl.[7] ..... H01J 49/40
(52) U.S. Cl. ..... 250/287; 708/300
(58) Field of Search ..... 250/287; 708/300

(56) References Cited

U.S. PATENT DOCUMENTS 6,586,728 B1 * 7/2003 Gavin et al. ..... 250/287
6,680,476 B1 * 1/2004 Hidalgo et al. ..... 250/287
2003/0057370 A1 * 3/2003 Youngquist et al. ..... 250/287

* cited by examiner

*Primary Examiner*—Jack I. Berman

(57) ABSTRACT

A mass spectrometer having an ion accelerator and an ion detector utilizing a finite impulse response filter is disclosed. The ion accelerator generates an ion pulse in response to a start signal. A clock increments a register that indicates the time that has elapsed since the start signal. The ion detector is spatially separated from the ion accelerator and generates a measurement signal indicative of ions striking the detector. The measurement signal is filtered through a finite impulse response filter to form a filtered measurement signal. The finite impulse response filter has a filter function that depends on the impulse response of the ion detector. In one embodiment, the mass spectrometer includes a memory that is addressed by the register value and an adder. The adder forms the sum of the data value specified by the register value and the output value from the finite impulse response filter.

4 Claims, 2 Drawing Sheets

TIME-OF-FLIGHT MASS SPECTROMETRY UTILIZING FINITE IMPULSE RESPONSE FILTERS TO IMPROVE RESOLUTION AND REDUCE NOISE

FIELD OF THE INVENTION

The present invention relates to time-of-flight mass spectrometers.

BACKGROUND OF THE INVENTION

In a time-of-flight mass spectrometer (TOFMS), the sample to be analyzed is ionized, accelerated in a vacuum through a known potential, and then the arrival time of the different ionized components is measured at a detector. The larger the particle, the longer the flight time; the relationship between the flight time and the mass can be written in the form:

$$\text{time}=k\sqrt{m}+c$$

where k is a constant related to flight path and ion energy, c is a small delay time, which may be introduced by the signal cable and/or detection electronics.

The detector converts ion impacts into electrons. The signal generated by the detector at any given time is proportional to the number of electrons. There is only a statistical correlation between one ion hitting the detector and the number of electrons generated. In addition, more than one ion at a time may hit the detector due to ion abundance.

The mass spectrum generated by the spectrometer is the summed output of the detector as a function of the time-of-flight between the ion source and the detector. The number of electrons leaving the detector in a given time interval is converted to a voltage that is digitized by an analog-to-digital converter (ADC). The dynamic range of the detector output determines the required number of ADC bits.

A mass spectrum is a graph of the output of the detector as a function of the time taken by the ions to reach the detector. In general, a short pulse of ions from an ion source is accelerated through a known voltage. Upon leaving the accelerator, the ions are bunched together but travelling at different speeds. The time required for each ion to reach the detector depends on its speed, which in turn, depends on its mass.

A mass spectrum is generated by measuring the output of the ADC as a function of the time after the ions have been accelerated. The range of delay times is divided into discrete "bins". Unfortunately, the statistical accuracy obtained from the ions that are available in a single such pulse is insufficient. Hence, the measurement is repeated a number of times and the individual mass spectra are summed to provide the final result.

There are two basic models for generating the mass spectrum. In the first model, the output from the detector is monitored for a pulse indicative of an ion striking the detector. When such a pulse is detected, the value of the detector output and the time delay associated with the pulse are stored in a memory. Such "event" spectrometers require less memory to store a spectrum since only the peaks are stored.

The second type of spectrometer avoids this discrimination problem by measuring the output of the detector on every clock pulse after the ions have been accelerated and summing the data even if it is likely to be noise. Since no data is discarded, such "summed" spectrometers can measure peaks that only appear above the background after a large number of scans are added together.

The resolution of the spectrometer depends on the number of bins into which the flight time measurements are divided, the duration of the ion pulse at the ion source, and the response time of the detector. As the number of bins is increased, the rate with which the output of the detector is sampled also increases and the signal-to-noise ratio decreases. As the number of bins is increased beyond still further, each molecular species in the sample will generate a peak that extends across a plurality of bins, further reducing the statistical significance of the count in any given bin during a single scan.

If the TOFMS has a noise level that is less than 1 ADC least significant bit (LSB) and a signal that is greater than 1 ADC LSB, a fine adjustment to the DC offset of the signal can be made such that the noise falls within ADC count 0 and 1. This assures that the signal sums, while the noise that occurs on the baseline does not.

As the sample rate is increased, a point is reached at which the noise is no longer less than the ADC LSB. To take advantage of faster sample rates, the analog bandwidth of the pre-amp and the input of the ADC are increased proportionally. Since noise increases as the square root of the bandwidth, faster sampling rates introduce more noise into the output data. In addition, ADCs that are optimized for high frequency signals may have increased noise when DC background signals are digitized.

Broadly, it is the object of the present invention to provide an improved TOFMS.

This and other objects of the present invention will become apparent to those skilled in the art from the following detailed description of the invention and the accompanying drawings.

SUMMARY OF THE INVENTION

The present invention is a mass spectrometer having an ion accelerator and an ion detector. The ion accelerator generates an ion pulse in response to a start signal. A clock increments a register that indicates the time that has elapsed since the start signal. The ion detector is spatially separated from the ion accelerator and generates a measurement signal indicative of ions striking the detector. The measurement signal is filtered through a finite impulse response filter to form a filtered measurement signal. The finite impulse response filter has a filter function that depends on the impulse response of the ion detector. In one embodiment of the invention, the mass spectrometer also includes a memory and an adder. The memory stores a plurality of data values at locations specified by said register value. The adder forms the sum of the data value specified by the register value and the output value from the finite impulse response filter.

DETAILED DESCRIPTION OF THE PREFERRED EMBODIMENTS OF THE INVENTION

Figure 1:
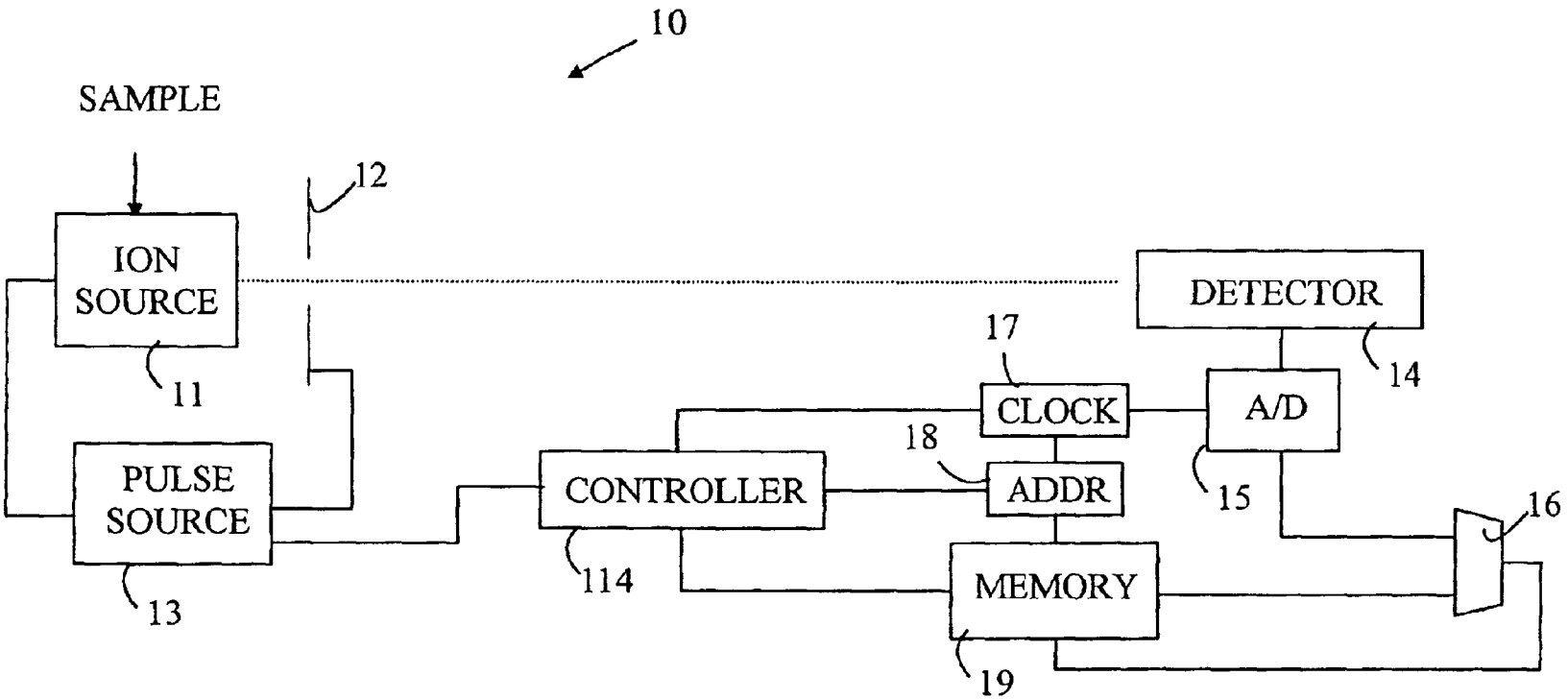
FIGURE 1 (PRIOR ART)
FIG. 1 is a schematic drawing of a typical prior art TOFMS.

The manner in which the present invention provides its advantages can be more easily understood with reference to FIG. 1, which is a schematic drawing of a typical prior art TOFMS 10. The sample to be analyzed is introduced into an ion source 11 that ionizes the sample. The ions so produced are accelerated by applying a potential between ion source 11 and electrode 12. At the beginning of each mass scan, controller 114 causes a short pulse to be applied between electrode 12 and ion source 11 by sending the appropriate control signal to pulse source 13. Controller 1 14 also resets the contents of address register 18. On subsequent clock cycles, address register 18 is incremented by the output of clock 17, and the signal generated by detector 14 is digitized by the analog-to-digital converter (ADC) shown at 15. The value stored in memory 19 at the address specified in address register 18 is applied to adder 16 which adds the stored value to the value provided by ADC 15. The summed value is then stored back in memory 19 at the address in question.

As noted above, the time required by an ion to traverse the distance between electrode 12 and detector 14 is a measure of the mass of the ion. This time is related to the value in address register 18 when the ion strikes the detector. Hence, memory 19 stores a graph of the number of ions with a given mass as a function of the mass.

The signal generated by the detector depends on the number of ions striking the detector during the clock cycle in question. In general this number is relatively small, and hence the statistical accuracy of the measurements obtained in any single mass scan is usually insufficient. In addition, there is a significant amount of noise in the system. The noise is generated both in the detector, the analog path, and in the ADC.

To improve the statistical accuracy of the data, the data from a large number of mass scans must be added together to provide a statistically useful result. At the beginning of the measurement process, controller 1 14 stores zeros in all of the memory locations in memory 19 and initiates the first mass scan. When the first mass scan is completed, controller 114 resets address register 18 and initiates another mass scan by pulsing electrode 12. The data from the second mass scan is then added to that from the previous mass scan. This process is repeated until the desired statistical accuracy is obtained.

As noted above, when the number of bins in a scan is increased in an attempt to increase the resolution of the mass spectrometer, a point is reached in which each peak extends over a plurality of bins. This further lowers the signal-to-noise ratio. In addition, the lower signal-to-noise ratio increases the difficulty associated with detecting an event in the first class of spectrometers discussed above.

Finally, two peaks in the resultant spectrum may overlap one another due to the finite time resolution of the ion detector. Such overlap will cause errors in the mass assignments unless the overlap is corrected. While mathematical techniques for "unfolding" such overlapping peaks to improve the resolution of the spectrum are known, such techniques require spectrum analysis that cannot be carried out on the data processing systems included in commercial mass spectrometers. Hence, the user must wait for the spectrums to be enhanced off-line. The resultant delays are problematic, particularly when the user is trying to adjust other parameters in the instrument.

The present invention is based on the observation that the impulse response of the detector is the limiting factor in increasing the resolution of many TOFMSs. As a result, the signal generated by different mass ions is the same independent of the mass of the ion.

Figure 2:
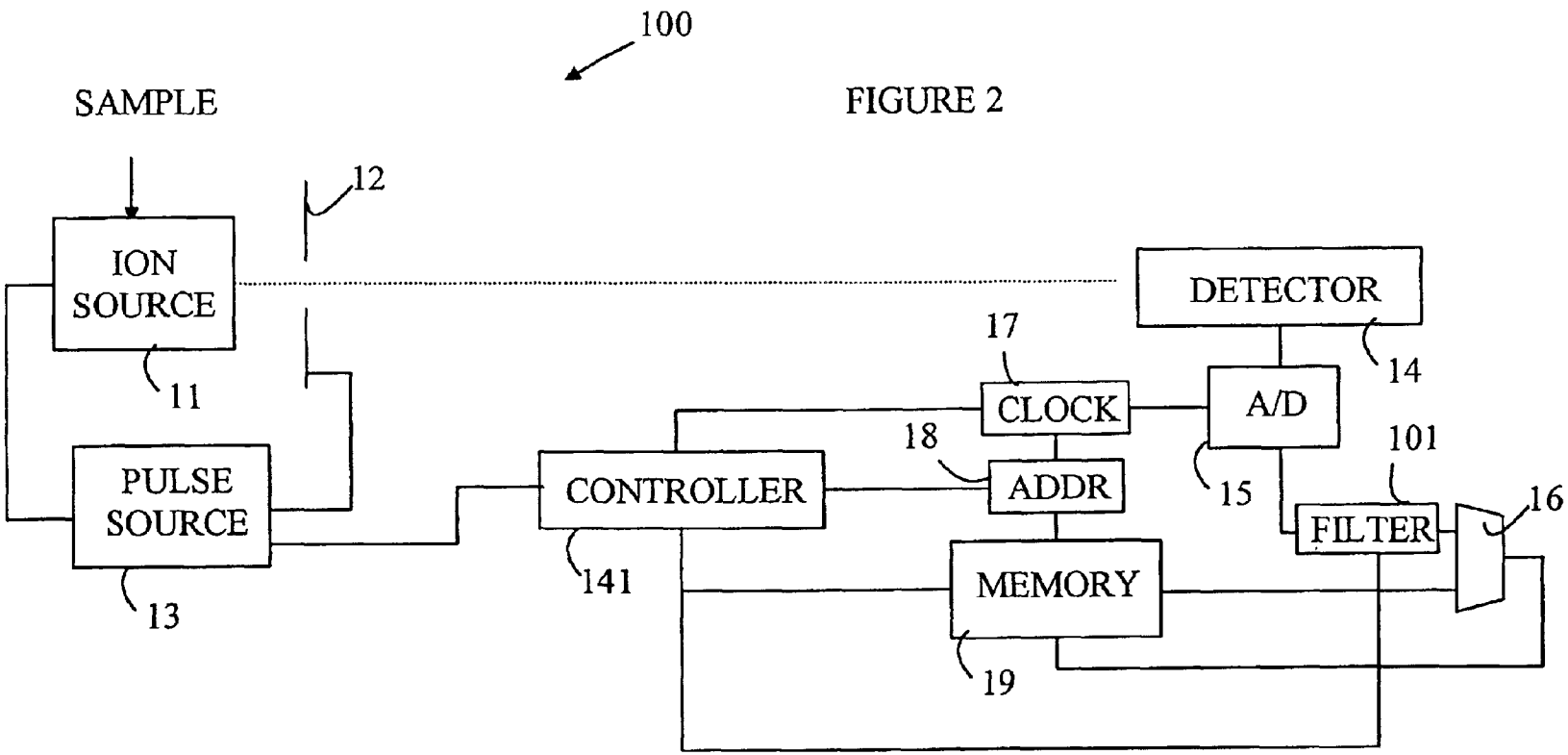
FIG. 2 is a schematic drawing of a TOFMS according to the present invention.

Refer now to FIG. 2, which is a block diagram of a TOFMS 100 according to the present invention. To simplify the drawing, those elements that serve functions analogous to elements discussed above with reference to FIG. 1 have been given the same numeric designations. The present invention provides a method to further improve the signal-to-noise ratio by filtering the output of the ADC via a finite impulse response filter 101 that has a filter function that matches the known impulse response of the ion detector. Filter 101 is under the control of controller 141.

Since the impulse response is independent of the time of flight of the ions being detected, a fixed filter function can be utilized. In the absence of both electronic and statistical noise, the output of the filter is a single value that exits the filter at a time delay characteristic of the flight time of the ions. The magnitude of this value is proportional to the number of electrons generated by the ions having that flight time. Hence, the filter converts a signal that would normally have a time duration that spreads the signal in time over a number of bins into a larger signal in a single bin. It should be noted that the filter utilizes data from a number of time bins, and hence, the filter provides a noise reduction function as well.

While the embodiment of the present invention shown in FIG. 2 is a summing type TOFMS, embodiments of the present invention can be practiced in an event type TOFMS as well. In such embodiments, the output of the ADC is filtered prior to the event detection circuitry such that the event detection circuitry operates on the output of the filter as if it were the conventional ADC output.

To construct a filter for use in the present invention, the frequency response of a characteristic peak generated by ions of a single mass is measured. The FIR filter is designed to match the measured frequency band or bands. Traditional digital filter design techniques can be used to design a low or bandpass filter with the steepest roll off that can be accommodated by the digital signal processing power of the system. Other embodiments in which the filter includes a combination of a low pass filter and multiple band pass filters can also be constructed.

The above-described embodiments of the present invention utilize a filter in which the filter function is independent of the time of flight of the ions. However, embodiments in which the filter function depends on the time of flight can also be practiced. In such an embodiment, controller 141 stores a plurality of filter functions. The specific filter function that is employed is determined by the value in address register 18. Such embodiments are useful if the ion pulse for a single species extends over a time period that is of the same order of magnitude as the response of the detector.

Various modifications to the present invention will become apparent to those skilled in the art from the foregoing description and accompanying drawings. Accordingly, the present invention is to be limited solely by the scope of the following claims.

What is claimed is:

1. A mass spectrometer comprising:

a clock for generating a series of clock pulses;

an ion accelerator for generating an ion pulse in response to a start signal;

a register for storing a register value that is incremented on each of said clock pulses;

an ion detector, spatially separated from said accelerator, for generating an ion measurement indicative of the ions striking said detector during each of said clock pulses; and a finite impulse response filter for filtering said ion measurements to generate filtered ion measurements, said finite impulse response filter having a filter function that depends on the impulse response of said ion detector.

2. The mass spectrometer of claim 1 wherein said filtered ion measurements have a time duration that is less than the time duration of said ion measurements.

3. The mass spectrometer of claim 1 wherein filter function depends on said register value.

4. The mass spectrometer of claim 1 further comprising:

a memory having a plurality of data values at locations specified by said register value; and an adder, responsive to said clock signal, for forming the sum of said data value specified by said register value and said filtered ion measurement specified by said register value and storing said sum in said memory at said location corresponding to said register value.

* * * * *